FIP7811 XR 4,043,597

United States Patent [19]

French

[11] 4,043,597

[45] Aug. 23, 1977

[54] MULTIPLE LEVEL PREPARATION OF OIL SHALE RETORT

[75] Inventor: Gordon B. French, Bakersfield, Calif.

[73] Assignee: Occidental Oil Shale, Inc., Grand Junction, Colo.

[21] Appl. No.: 658,699

[22] Filed: Feb. 17, 1976

Related U.S. Application Data

[63] Continuation-in-part of Ser. No. 602,929, Aug. 8, 1975, abandoned, which is a continuation of Ser. No. 464,957, April 29, 1974, abandoned.

[51] Int. Cl.[2] ..... E21B 43/24; E21B 43/26; E21C 41/10

[52] U.S. Cl. ..... 299/2; 102/23; 166/259; 166/299; 299/13

[58] Field of Search ..... 299/2, 4, 5, 13; 166/247, 259, 299; 102/23

[56] References Cited

U.S. PATENT DOCUMENTS

| | | | |
|---|---|---|---|
| 1,842,664 | 1/1932 | Elsing | 299/13 X |
| 3,001,776 | 9/1961 | Van Poollen | 299/2 |
| 3,582,138 | 6/1971 | Loofbourow et al. | 299/13 |
| 3,688,843 | 9/1972 | Nordyke | 166/247 |
| 3,712,677 | 1/1973 | Janssen | 299/13 |
| 3,957,306 | 5/1976 | Closmann | 299/4 |

OTHER PUBLICATIONS

Jackson et al., "Stoping Methods and Costs", U.S. Dept. of the Interior, Bureau of Mines Bulletin No. 390, 1936, pp. 2–19.

E. I. Du Pont de Nemours & Company, Blasters Handbook, 1969, pp, 240–244, 343–345.

Cummins et al., SME Mining Engineering Handbook, Society of Mining Engineers, 1972, pp. 12–5, 12–135 through 12–150, and 12–162 through 12–233.

*Primary Examiner*—Stephen J. Novosad
*Assistant Examiner*—George A. Suchfield
*Attorney, Agent, or Firm*—Christie, Parker & Hale

[57] ABSTRACT

A subterranean deposit containing oil shale is prepared for in situ retorting by initially excavating a plurality of vertically spaced apart voids of similar horizontal cross section located one above another within the deposit. A zone of unfragmented deposit temporarily left between each adjacent pair of voids has a thickness greater than the smallest lateral dimension of the voids above and below it. Explosive placed in a lower portion of the unfragmented zone is detonated to expand the lower portion of the unfragmented zone into the lower void, leaving the upper portion of the zone intact and creating a space free of fragmented particles below it. Thereafter, the remaining portion of the unfragmented zone is explosively expanded into the open space below it and into the upper void, forming a subterranean room filled with a fragmented mass of particles having a void volume substantially equal to the total initial volume of the voids. Retorting of the expanded mass is then carried out to recover shale oil from the oil shale.

31 Claims, 2 Drawing Figures

MULTIPLE LEVEL PREPARATION OF OIL SHALE RETORT

BACKGROUND OF THE INVENTION

This is a continuation in part of U.S. patent application Ser. No. 602,929, filed Aug. 8, 1975, which was a continuation of U.S. patent application Ser. No. 464, 957, filed Apr. 29, 1974, both of which are now abandoned.

This invention relates to the recovery of constituents from subterranean ore deposits, and more particularly to an in situ method of recovery that is particularly effective for the production of shale oil from oil shale in an in situ retort. The term "oil shale" as used in the industry is in fact a misnomer; it is neither shale nor does it contain oil. It is a formation comprising marlstone deposit containing an organic material called "kerogen" which upon heating decomposes to produce carbonaceous liquid and gaseous products. It is the deposit containing kerogen that is called "oil shale" herein, and the liquid product is called "shale oil".

U.S. Pat. No. 3,661,423 discloses a method of recovering carbonaceous values including shale oil from an oil shale deposit in situ by detonating explosive charges dispersed through the recovery zone of the deposit to produce an expanded mass of oil shale particles. This forms an in situ oil shale retort comprising boundaries of unfragmented shale containing a fragmented permeable mass of oil shale particles. Retorting of the expanded mass is then carried out by igniting the upper level of the expanded deposit to establish a combustion zone. An oxygen containing or supplying gas is introduced into the top of the retort to sustain the combustion zone, which proceeds slowly down through the fragmented shale in the retort. As burning proceeds, the heat of combustion is transferred to the shale below the combustion zone to release shale oil and gases therefrom in a retorting zone. Thus, a retorting zone moves from top to bottom of the retort in advance of the combustion zone, and the resulting shale oil and gases pass to the bottom of the retort for collection.

It is desirable that the expanded mass have a uniformly distributed void volume or void fraction so that gases will flow uniformly through the expanded deposit and result in a maximum conversion of kerogen to shale oil. The creation of a mass of expanded particles of uniform void volume distribution prevents the formation of over-sized voids or channels which hinder total recovery of shale oil and also provides a uniform pressure drop through the entire mass of particles. In preparation for the described retorting process, it is important that the shale be fragmented, rather than simply fractured in order to create high permeability; otherwise, too much pressure differential is required to pass the gas through the retort.

It has been proposed that deposits be prepared for in situ recovery by first undercutting a portion of the formation to remove about 5% to 25% of the volume of the deposit. The overlying deposit is then expanded by detonating explosives embedded in the deposit to fill the void created by the undercut. One method of explosive expansion is the so-called "V-cut" method in which explosive charges are so arranged within the deposit and detonated in sequence so that the deposit is expanded in concentric sequential steps moving radially outwardly and upwardly within the deposit, generating a conical free face which propagates upwardly through the deposit in accordance with the time delays between the explosive charges. The purpose of the V-cut method of expansion is to produce oil shale particles of relatively small size but it has the disadvantage of tending to create a radially non-uniform void volume distribution throughout the expanded mass, because the explosive charges tend to push more fragmented particles toward the center of the mass. The general art of blasting rock deposits is discussed in *The Blasters' Handbook,* 15th Edition, published by E. I. duPont de Nemours & Company, Wilmington, Delaware.

BRIEF SUMMARY OF THE INVENTION

There is provided in practice of this invention according to presently preferred embodiments a method for forming an in situ oil shale retort containing a fragmented permeable mass of oil shale particles in a subterranean deposit, which comprises the steps of excavating a plurality of vertically spaced apart voids with a zone of unfragmented deposit between adjacent voids and within the boundaries of the in situ oil shale retort being formed, explosively expanding at least one lower portion of such an unfragmented zone downwardly toward a lower void, and thereafter explosively expanding an upper remaining portion of such an unfragmented zone at least partly toward an upper void to form a fragmented permeable mass of particles within the boundaries of the in situ oil shale retort being formed. Features of the method can include forming the void so that the horizontal cross section of each void is substantially similar to the horizontal cross section of the retort being formed, forming a retort wherein the void volume of the fragmented permeable mass of particles in the retort is substantially equal to the total volume of the voids within the boundaries of the retort being formed, or explosively expanding such an unfragmented zone by forming a plurality of vertically extending blasting holes in such an unfragmented zone, placing explosive in the blasting holes and detonating the explosive.

BRIEF DESCRIPTION OF THE DRAWINGS

These and other aspects of the invention will be more fully understood by referring to the following detailed description and the accompanying drawings in which.

DETAILED DESCRIPTION

The drawings illustrate a subterranean deposit 10, such as an oil shale deposit which is in an intermediate stage of preparation for in situ recovery of the carbonaceous values such as shale oil and hydrocarbon gaseous products in retorting off gas. Generally speaking, in situ recovery is carried out by initially removing oil shale from certain volumes of the subterranean deposit and then explosively expanding a remaining portion of the oil shale in the deposit to produce a vertically extending fragmented permeable mass of oil shale particles. The present invention will be described in the context of a method for ultimately producing a subterranean vertical retort comprising a vertically extending room 12 (illustrated in phantom lines in FIGS. 1 and 2) filled with a fragmented permeable mass of expanded oil shale particles having a uniformly distributed void volume desired for economical vertical retorting operations. In the illustrated embodiment, the room 12 is square in horizontal cross section, and for most efficient retorting the vertical dimension or height of the room 12 is greater than the maximum lateral dimension or width of the room.

Figure 2:
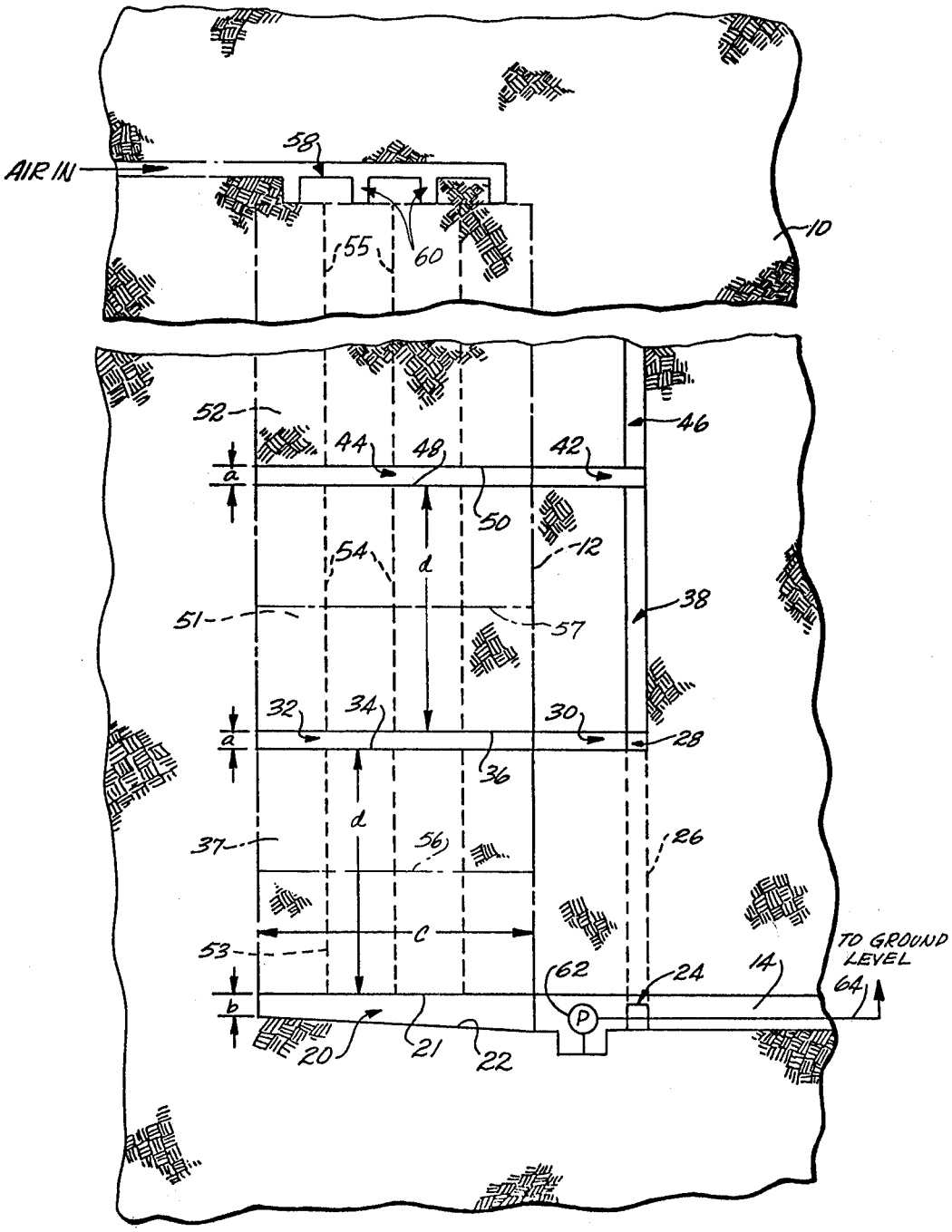
FIG. 2 is a schematic cross-sectional elevation view taken on line 2—2 of FIG. 1.

Referring to FIG. 2, access to the portion of the oil shale deposit to be expanded is established by forming a horizontal tunnel, drift or adit 14 extending to the bottom of the volume to be expanded. From the adit 14, the oil shale deposit is undercut and a volume of deposit is removed to form a lower void 20 at the bottom of the subterranean room 12 to be formed. The material excavated from the lower void is hauled away through the tunnel 14.

The lower void 20 is preferably continuous across the width of the volume to be expanded, so that the deposit overlying the lower void is completely unsupported and defines a horizontal free face 21 of the formation immediately above the lower void. If desired one or more pillars of unfragmented deposit can be left in the void to help support overlying deposit. Preferably, the floor plan or horizontal cross section of the lower void 20 is generally square although the void, and also the subterranean room 12 to be formed generally, can be of other horizontal cross section such as rectangular without departing from the scope of the invention. The floor 22 of the lower void is inclined downwardly in the direction of the adit 14 to facilitate the flow of shale oil in the direction of the adit during subsequent retorting operations.

After the lower void 20 is excavated, or concurrently therewith, a horizontal or upwardly sloping tunnel or "lateral" 24 is excavated. The far end of the lateral opens into an upwardly inclined tunnel or "raise" 26. The top 28 of the raise 26 provides access for excavating a horizontal tunnel 30 above the level of the bottom void 20. The lateral 24 and raise 26 form a dogleg access to the tunnel 30. Other access can also be provided such as a sloping tunnel from the drift 14 or a separate adit leading to the ground surface. From the horizontal access tunnel 30, oil shale is removed from the volume to be expanded to form an intermediate void 32 spaced vertically above the lower void 20. The floor plan or horizontal cross section of the intermediate void 32 matches the horizontal cross section and area of the lower void 20 (and the room 12 to be formed). Thus, the intermediate void is preferably square in shape, and is substantially directly above the lower void so that the outer edges of the two voids preferably lie in common vertical planes. The height of the intermediate void can be less than that of the lower void if less bulky machinery is employed for excavation. The intermediate void also is continuous across the width of the room 12 such that the overlying portion of the deposit is completely unsupported, thereby defining a pair of vertically spaced apart bottom and top horizontal free faces 34 and 36, respectively, adjoining intermediate void 32. The two voids 20 and 32 also define a lower zone 37 of unfragmented oil shale left within the boundaries of the subterranean room 12 between the free faces 21 and 34.

After the intermediate void 32 is formed, or concurrently therewith, oil shale is removed from the deposit adjacent room 12 being formed to form a vertical raise 38 extending upwardly from the tunnel 30 to provide access for excavating a horizontal tunnel 42 above the level of the intermediate void 32. Oil shale is removed from within the boundaries of the room 12 being formed through the tunnel 42 to form an upper void 44 spaced vertically above the intermediate void 32. The floor plan or horizontal cross section of the upper void 44 is substantially similar to the generally square horizontal cross section being formed and the lower and intermediate voids of the room 12. The upper void also is aligned with the voids below it so that the outer edges or the upper void lie in common vertical planes with the outer edges of the voids below. The upper void 44 is approximately the same height as the intermediate void 32, and is also continuous across the width of the room 12. Thus, the portion of the deposit above it is completely unsupported. If desired one or more pillars of unfragmented deposit can be left in the upper and intermediate voids to help support the overlying deposit. The upper void defines a pair of vertically spaced apart bottom and top horizontal free faces 48 and 50, respectively, on the unfragmented deposit adjoining the void. The two voids 32 and 44 also define a zone 51 of unfragmented deposit left between the free faces 36 and 48. An intact zone 52 of unfragmented deposit also is left above the uppermost free face 50.

The technique for expanding oil shale illustrated in the drawings has one intermediate void between the upper void and the lower void, although in practice there can be multiple intermediate voids one above another, depending upon the height of the volume to be expanded. Thus, the drawing illustrates a further vertical raise 46 extending upwardly from the tunnel 42 for the purpose of gaining access to a higher level in the deposit in the event multiple intermediate voids are to be excavated within the boundaries of the room 12.

Multiple intermediate voids can be useful where the height of the retort being formed is very much larger than its width. It is preferred that at least one or two intermediate voids be excavated between the top and bottom voids so that the in situ retort has a substantially greater height than width. As pointed out hereinafter, a particularly suitable retorting technique employs downward flow of gas from an upper level of the fragmented permeable mass toward the bottom where products of retorting are recovered. Good gas flow distribution and control of the retorting zone in the retort can be obtained with such a construction.

It is also preferred that the voids have rectangular horizontal cross sections with edges coplanar with each other in common vertical planes. Rectangular retorts are well adapted to close packing of retorts in a region being developed and leave minimal amounts of oil shale in walls or pillars between adjacent retorts. This maximizes total recovery of valuable products from the region. The vertical arrangement of the voids and hence the retorts also furthers recovery from the region while still giving support for overlying deposits.

Conventional underground mining techniques and equipment are used for excavating the voids and the access tunnels, raises and the like.

After the multiple spaced apart voids have been excavated in the oil shale deposit, the intervening unfragmented zones 37 and 51 and the intact oil shale 52 above the upper void 44 are prepared for explosive expansion and subsequent retorting operations. Vertical blasting holes 53 are drilled in the lower unfragmented zone 37 upwardly from the lower void 20 or downwardly from the intermediate void 32. Similarly, vertical blasting holes 54 are drilled in the upper unfragmented zone 51 from the intermediate void 32 or the upper void 44, and vertical blasting holes 55 are drilled upwardly into the intact zone 52 from the upper void 44. The unfragmented zones 37 and 51 and the intact oil shale 52 above the upper void are then explosively expanded in "lifts" by the following technique.

The bottoms of the blasting holes 53 in the lower unfragmented zone 37 are plugged and the lower portions of the holes are then filled with explosive such as ammonium nitrate-fuel oi. The explosive is dispersed through the unfragmented zone 37 so that when the explosives are detonated they expand only the lower portion of the unfragmented zone 37 (for example, up to a level represented by phantom line 56 in FIG. 2) into the lower void 20. This fills the lower void 20 with a mass of fragmented oil shale particles, or rubble, leaving intact oil shale in the remaining portion of the zone 37 above the level 56, and creating a space free of fragmented oil shale particles immediately below a new horizontal free face (represented by phantom line 56) at the bottom of the remaining portion of unfragmented oil shale in the lower unfragmented zone 37. Detonation of explosive in the lower portion of the zone 37 also may cause some of the shale in the upper remaining portion of the unfragmented zone to expand into the overlying void 32. This is in the form of minor spalling from the top free face of the unfragmented zone upon reflection of the shock wave of the explosion from the free face.

The bottoms of the portion of the blasting holes 53 which remain after detonation are then plugged, preferably from access gained by way of the intermediate void 32, and the remaining portions of the blasting holes are filled with explosive. The explosives are then detonated to expand the remaining portion of the unfragmented zone 37 upwardly into the void 32 and downwardly into the open space below the portion of zone 37 which remains after the first explosive expansion, i.e. over the mass of oil shale particles from expanding the first lift.

Thus, in the example illustrated in the drawings, the oil shale in the lower unfragmented zone 37 is completely expanded in two consecutive steps or "lifts". However, depending upon the amount by which the thickness or depth of the zone (represented by the dimension *d* in FIG. 2) exceeds its minimum lateral dimension (represented by the dimension *c* in FIG. 2), the zone may be fragmented in more than two lifts. In this instance, the steps followed in explosive expansion of the unfragmented zone are the same as those described above. The lower portion of the shale remaining in the unfragmented zone is expanded during each lift, and the portions of the blasting holes 53 remaining after each expansion are plugged and charged with explosive prior to each successive expansion. The factors which determine the number of lifts per zone are described in more detail below.

After the shale in the lower unfragmented zone 37 is completely expanded, the intermediate unfragmented zone 51 is explosively expanded in lifts in the same manner as the lower zone 37. The bottoms of the blasting holes 54 in the intermediate unfragmented zone 51 are plugged in preparation for filling the lower portions of the holes 54 with explosive. Explosive charges are dispersed in the lower portions of the blasting holes 54 so that subsequent detonation of the explosives will expand only a lower portion of the intermediate unfragmented zone 51 (up to a level represented by phantom line 57 in FIG. 2) into the intermediate void 32. This leaves a section of intact oil shale in the remaining portion of the unfragmented zone 51 above the level indicated by the line 57. The remaining portion of the intermediate void 32 receives the rubble of oil shale particles from expansion. Above the rubble there is a space free from particles, immediately below the new horizontal free face (represented by the phantom line 57) at the bottom of the portion of the shale which remains intact in the unfragmented zone 51. The bottoms of the remaining portions of the blasting holes 54 are then plugged and sufficient explosive dispersed in the holes so that subsequent detonation completely expands the remaining portion of the unfragmented zone 51 upwardly into the upper void 44 and downwardly into the open space above the rubble of oil shale particles previously expanded.

In the example illustrated in the drawings, the intermediate unfragmented zone 51 is completely expanded in two lifts, but depending upon the amount by which the thickness of the unfragmented zone 51 exceeds the minimum lateral dimension of the voids, the zone may be fragmented in more than two lifts.

After fragmentation of the intermediate zone 51 is completed, any remaining oil shale zones above the intermediate zone 51 are explosively expanded in lifts, one zone at a time, until the entire subterranean room 12 is completely expanded. It is preferable to explosively expand the entire top zone of intact shale above the top void simultaneously with the final explosive expansion of the unfragmented zone immediately below it. In the example illustrated in the drawings wherein the intact zone 52 is present above the top void 44, the blasting holes 55 above the top void are filled with explosive and stemmed at the same time the intermediate zone 51 is being prepared for explosive expansion. Moreover, the detonation of explosive in the overlying intact zone 52 is controlled so that the entire overlying zone 52 is expanded in a single round with the final explosive expansion of the intermediate zone 51. That is, the explosives in the blasting holes 54 and 55 are detonated simultaneously or with only short time delays.

Figure 1:
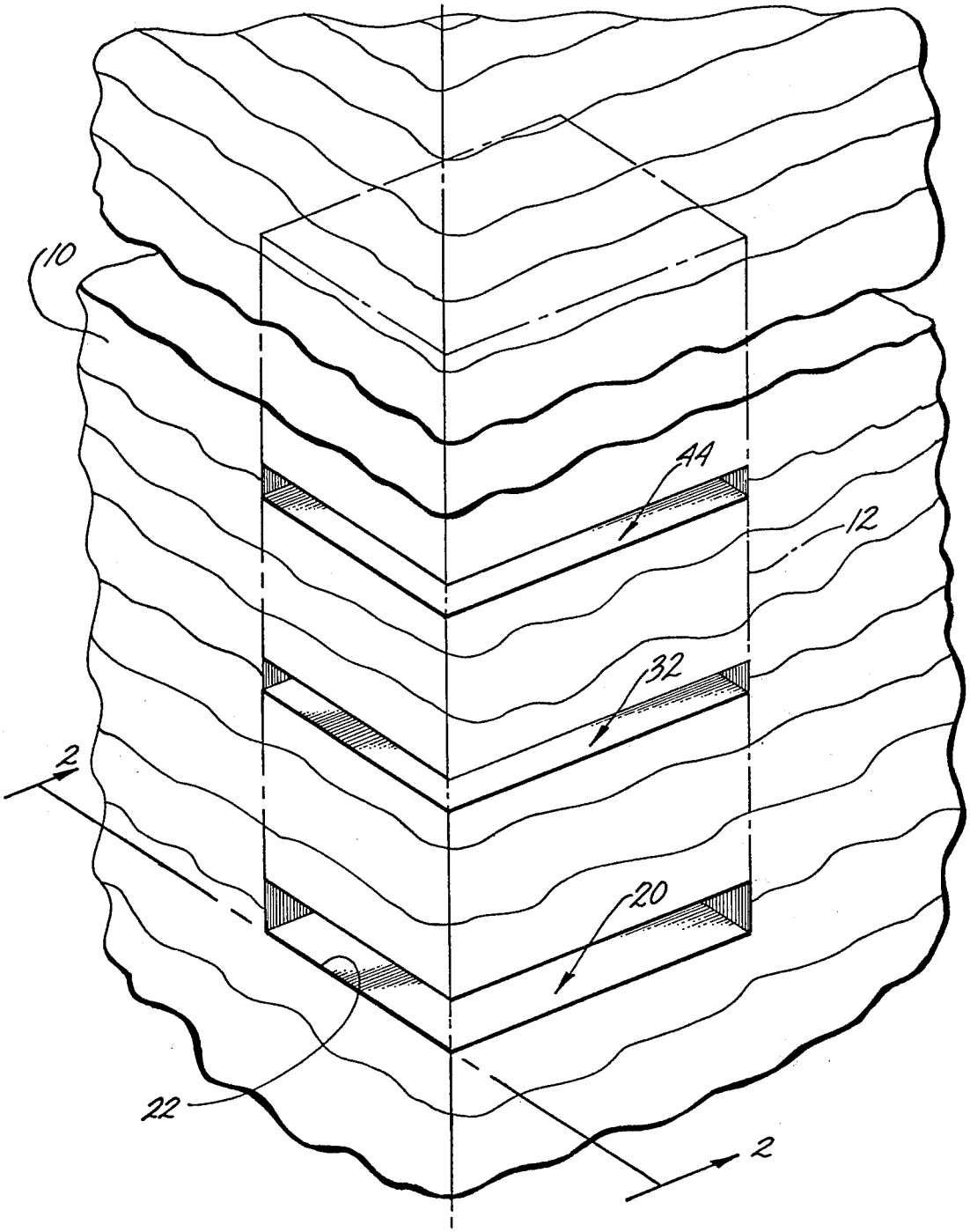
FIG. 1 is a schematic perspective view showing an oil shale deposit in an intermediate stage of preparation for in situ recovery in accordance with principles of this invention.

The explosive charges are so arranged within the unfragmented zones of oil shale that the shape of the in situ retort 12 after detonation is approximately square in horizontal cross section continuously from top to bottom, as illustrated by phantom lines in FIG. 1.

Physical characteristics of conventional explosive expansion place an apparent limit on the thickness of oil shale which can be expanded in a single round. The maximum thickness or depth of oil shale which can reliably be fragmented is about 95% of the minimum lateral dimension of a void into which it expands. If one attempts to explosively expand oil shale from a thickness or depth greater than about 0.95 times the smallest lateral dimension of the free face adjoining the void towards which expansion occurs, incomplete fragmentation can occur. The oil shale near the free face and at distances up to 0.95 times its smallest lateral dimension can expand and fragment. Oil shale further from the face may not fragment because of physical constraints imposed by surrounding unfragmented rock. Explosive in such oil shale further from the free face can cause fracturing, which would yield insufficient permeability for good in situ retorting. Hence, the thickness of each section of oil shale which is explosively expanded downwardly during a given detonation or "lift" is less than about 95% of the minimum horizontal dimension of the free face adjoining the underlying void.

In the embodiment described herein the remaining portion of each unfragmented zone after expansion of the lower portion of the zone has two parallel free faces between the void above the zone and the space above the fragmented shale below the zone. This unfragmented portion can expand in the final portion toward both upper and lower free faces simultaneously. This affords some relief from the constraint of 95% which characterizes expansion into a single void adjoining a single free face. Expansion to assure fragmentation of all of the remaining portion of the unfragmented deposit upon detonation is preferably limited to a thickness of no more than about twice the smallest lateral dimension of the free faces adjoining the voids. This promotes full fragmentation with minimal possibility of unfragmented masses of appreciable size remaining in the fragmented permeable mass of particles.

Preferably the maximum thickness of the remaining portion of each zone of unfragmented oil shale which is expanded both upwardly and downwardly is limited to about 190% of the minimum horizontal dimension of the zone or the voids toward which the remainder of the unfragmented zone is expanded.

The distributed void fraction of the permeable mass of particles in the retort, i.e., the ratio of the void volume to the total volume in the subterranean in situ retort 12, is controlled by the volume of the excavated voids toward which the deposit is expanded. The total volume of the voids is sufficiently small compared to the total volume of the retort that the expanded oil shale is capable of filling the voids and the space occupied by the expanded shale prior to expansion. In other words, the volume of the voids is not so large that the expanded shale occupies less than the entire space of the voids and the space occupied by the expanded shale prior to detonation of the explosive. In filling the voids and the space occupied by the unfragmented zones prior to fragmentation, the particles of the expanded shale become jammed and wedged together tightly so they do not shift or move after fragmentation has been completed. In numerical terms, the total volume of the voids should be less than about 40% of the total volume of the retort being formed to fill the voids and the space occupied by the expanded shale prior to fragmentation. In one embodiment of this invention, the volume of the voids is preferably not greater than about 20% of the volume of the retort, as this is found to provide a void volume in the fragmented oil shale adequate for satisfactory retorting operation. If the void volume is more than about 20% an undue amount of excavation occurs without concomitant improvement in permeability. Removal of the material from the voids is costly and kerogen contained therein is wasted or retorted by costly above ground methods.

The total volume of the voids is also sufficiently large compared to the total volume of the retort that substantially all of the expanded shale within the retort is capable of moving enough during explosive expansion to fragment and for the fragments to be displaced and/or reoriented. If the volume of the voids is too small, significant quantity of the shale within the retort volume can fracture without fragmenting. If the shale fractures without fragmenting, as when the space for explosive expansion of the shale is insufficient, fissures can be formed and the shale frozen in place without fragmentation. The void volume in fractured (but not fragmented) shale is neither large enough nor suitably distributed for efficient in situ retorting, and the permeability is too small to provide a desired gas flow rate through the retort with a reasonable pressure differential.

When the fragmented shale particles are later retorted, they increase in size. Part of this size increase is temporary and results from thermal expansion, and part is permanent and is brought about during the retorting of kerogen in the shale. The void fraction of the fragmented permeable mass of shale particles should also be large enough for efficient in situ retorting as this size increase occurs. In numerical terms, the minimum volume of the voids in view of the above considerations should be above about 10% of the total volume of the retort. Below this average percentage value, an undesirable amount of power is required to drive the gas blowers causing retorting gas to flow through the retort.

Within the preferred range of from about 10% to 20%, the particularly preferred average void fraction is about 15%. Data collected to date from work in the Piceance Basin of Colorado indicate this value provides a good balance among the various characteristics of the retort, i.e., void volume, permeability, and particle size, without having to excavate excessive amounts of oil shale to form the voids. For example, an in situ retort having this void fraction and a height of about 100 feet can have a pressure differential of less than about 1 psi from top to bottom for vertical movement of gas down through the retort at about 1 to 2 standard cubic feet per minute (scfm) per square foot of horizontal cross section of the retort. Retorts having greater heights have proportionally larger pressure drops. Thus, an adequate gas flow rate through retorts up to 1000 feet in height can be provided with a pressure differential of less than about 10 psi from top to bottom. In some areas of the Piceance Basin, a gas pressure of greater than 10 psi is objectionable because it results in excessive gas leakage into unfragmented shale around the retort.

The above percentage values assume that all the shale within the boundaries of the retort is to be fragmented; that is, there are no unfragmented regions left in the retort. If there are unfragmented regions left in the retort, e.g., for support pillars or the like, the percentages would be less.

In one example of practice of this invention, the total height of the in situ retort or room 12 is about 175 to 180 feet. The intermediate void 32 and upper void 44 each have a height (represented by the dimension *a* in FIG. 2) of about 9 feet, and the height (represented by the dimension *b*) of the lower void 20 is about 12 feet. Each unfragmented zone 37 and 51 and the unfragmented shale 52 above the top void is about 35 feet square (represented by dimension *c* in FIG. 2) in horizontal cross section, which essentially matches the horizontal cross section of the voids 20, 32, and 44, although these can be a foot or so wider to accommodate drilling equipment near the edges. The thickness (represented by the dimension *d* ) of each unfragmented zone of oil shale, exclusive of the upper zone 52, is about 60 feet. Thus, when the zones 37 and 51 are expanded in two lifts, each lift (represented by the phantom lines 56 and 57) has a thickness of about 30 feet, that is, less than about 95% of the minimum horizontal dimension of the voids. The thickness of the intact zone 52 above the upper void 44 is about 30 feet.

The total thickness of the unfragmented zones 37 and 51 can be less than the 60 foot dimension referred to in the example above, in which case there is preferably a corresponding decrease in the vertical dimension of the voids so that the average void volume of the fragmented shale will be in the range of about 10% to 20%.

The above described method of fragmenting each unfragmented zone of the deposit in a plurality of sequential portions from the bottom up allows a limited vertical thickness of shale in each zone to be fragmented completely and substantially uniformly during each detonation.

Following explosive expansion of the oil shale, at least one gas access communicating with an upper level of the retort 12 is established by forming a horizontal tunnel 58 and several communicating vertical conduits 60 to the top level of the expanded oil shale contained in the room.

The recovery of shale oil and gaseous products from the oil shale in the retort generally involves the movement of a retorting zone through the fragmented permeable mass of particles in the retort. The retorting zone can be established on the advancing side of a combustion zone in the retort or it can be established by passing heated gas through the retort. It is generally preferred to advance the retorting zone from the top to the bottom of a vertically oriented retort, i.e. a retort having vertical side boundaries so that the shale oil and product gases produced in the retorting zone will move by the force of gravity and with the aid of gases (air or heated gases) introduced at an upper level and moving toward the base of the retort for collection and recovery.

A combustion zone can be established at or near the upper boundary of a retort by any of a number of methods. Reference is made to application Ser. No. 536,371, filed Dec. 26, 1974 now abandoned, by Chang Yul Cha, and assigned to the assignee of the present application, for one method in which an access conduit 56 is provided to the upper boundary of the retort, a combustible gaseous mixture is introduced therethrough, and ignited in the retort. Off gas is withdrawn through an access means (such as the tunnel 14) extending to the lower boundary of the retort, thereby bringing about a movement of gases from top to bottom of the retort through the fragmented oil shale. A combustible gaseous mixture of a fuel, such as propane, butane, natural gas, or retort off gas, and air is introduced through the access conduit to the upper boundary and is ignited to initiate a combustion zone at or near the upper boundary of the retort. Combustible gaseous mixtures of oxygen and other fuels are also suitable. The supply of the combustible gaseous mixture to the combustion zone is maintained for a period sufficient for the oil shale at the upper boundary of the retort to become heated, usually to a temperature of greater than about 900° F., (although retorting begins at about 600° F.) so that combustion can be maintained by the introduction of air (without fuel gas) into the combustion zone. Such a period can be from about one day to about a week in duration.

The combustion zone is maintained and advanced through the retort toward the lower boundary by introducing an oxygen-containing inlet gas through access conduits to the upper boundary of the retort and withdrawing gas from below the retorting zone. The inlet gas is generally a mixture of air and a diluent such as retort off gas or water vapor having an oxygen content of about 10% to 20% of the volume of the inlet gas. The inlet gas is moved through the retort at a rate of about 0.5 to 2 standard cubic feet of gas per minute per square foot of cross-sectional area of the retort.

The introduction of an inlet gas at the top and the withdrawal of off gases from the retort at a lower level serves to maintain a downward pressure differential of gas to carry hot combustion product gases and non-oxidized inlet gases (such as nitrogen, for example) from the combustion zone downwards through the retort. This flow of hot gas establishes a retorting zone on the advancing side of the combustion zone wherein expanded oil shale is heated and carbonaceous values therein liquefied. In the retorting zone, kerogen in the oil shale is converted to liquid and gaseous products. The liquid products, including shale oil, move by the force of gravity to the base of the retort where they are collected and withdrawn. The gaseous products from the retorting zone mix with the gases moving downwardly through the in situ retort and are removed as retort off gas from a level below the retorting zone. The retort off gas is the gas removed from such lower level of the retort and includes inlet gas, flue gas generated in the combustion zone, and product gas generated in the retorting zone.

Many oil shale deposits have bedding plane dips of less than about 5°, in which case the edges of the vertically spaced apart voids should be in a substantially vertical plane and the resulting retort has substantially vertical side boundaries. If the dip of the oil shale deposit is more than about 5°, the voids can have their edges offset and be tilted so that the free faces of the intervening unfragmented zone are substantially parallel to the plane of the deposit. The result would be a retort that is re-oriented accordingly to conform to the bedding plane so that the side boundaries of the retort are perpendicular to the bedding plane. This provides oil shale having approximately the same kerogen content across the retorting zone at any particular time as it advances through the retort.

The above described use of the invention for recovering carbonaceous values including shale oil from oil shale deposits is for illustrative purposes only, and is not considered to be a limitation of the scope of the invention. For example, the invention can be used in a variety of instances where it is desirable to prepare subterranean ore deposits for in situ recovery where the particle size and subsequent void volume distribution of the ore particles are to be controlled to maximize the recovery of constituents from the deposit.

What is claimed is:

1. A method for forming an in situ oil shale retort containing a fragmented permeable mass of oil shale particles in a subterranean deposit containing oil shale comprising the steps of:

excavating at least a lower void and an upper void, each void having a horizontal cross section substantially similar to the horizontal cross section of the in situ oil shale retort being formed, the upper void being located substantially directly above the lower void, leaving an intervening unfragmented zone of deposit between the upper and lower voids;

placing explosive in a lower portion of the unfragmented zone;

detonating the explosive to explosively expand the lower portion of the unfragmented zone into at least the lower void and produce a fragmented permeable mass of particles and a space free of fragmented particles below a remaining portion of the unfragmented zone.

placing explosive in the remaining portion of the unfragmented zone; and detonating the explosive in the remaining portion to explosively expand the remaining portion of the unfragmented zone into the upper void and the space free of fragmented particles below the remaining portion of the unfragmented zone to thereby produce a fragmented, permeable mass of particles within the boundaries of the in situ oil shale retort being formed, wherein the void volume of the fragmented permeable mass of particles is substantially equal to the total initial volumes of the upper and lower voids.

2. The method according to claim 1 wherein the excavating step comprises forming a sufficient number of vertically spaced apart voids to produce a subterranean in situ oil shale retort having a greater height than width after explosive expansion of intervening unfragmented zones.

3. The method according to claim 2 wherein each void is excavated to a generally rectangular horizontal cross section with the corresponding edges of the rectangles generally coplanar with one another so that the in situ oil shale retort produced after expansion of intervening unfragmented zones is of generally rectangular horizontal cross section from top to bottom.

4. The method according to claim 1 wherein adjacent voids are spaced apart so that the vertical dimension of the intervening unfragmented zone is greater than the smallest lateral dimension of either the upper or lower void.

5. The method according to claim 1 wherein the combined volume of the voids equals about 10% to 20% of the total volume of the desired subterranean in situ oil shale retort after expansion.

6. The method according to claim 1 wherein the second step of placing explosive comprises loading explosive into the remaining unfragmented zone from the work space provided by the upper void after the first detonation step.

7. The method according to claim 1 wherein the excavating step comprises forming a plurality of said vertically spaced apart voids which are separated by a plurality of said unfragmented zones spaced vertically apart above one another within the deposit; and wherein alternating steps of placing explosive and detonating the explosive are carried out for completely fragmenting the ore in the unfragmented zones one zone at a time, from the bottom up, by following said alternating steps, until all unfragmented zones are explosively expanded to produce a fragmented permeable mass of particles within the boundaries of the in situ oil shale retort being formed and having a void volume substantially equal to the total volume of all voids initially formed in the portion of the deposit within the boundaries of the in situ oil shale retort being formed.

8. A method of recovering shale oil from a subterranean deposit containing oil shale comprising the steps of:

excavating at least a lower void and an upper void, each void having a horizontal cross section substantially similar to the horizontal cross section of the in situ oil shale retort being formed, the upper void being located substantially directly above the lower void, leaving an intervening unfragmented zone of the deposit between the upper and lower voids, the unfragmented zone having a thickness greater than the smallest lateral dimension of either the upper or lower void;

placing explosive in a lower portion of the unfragmented zone;

detonating the explosive to explosively expand the lower portion of the unfragmented zone into at least the lower void and produce a fragmented permeable mass of particles and a space free of fragmented particles below a remaining portion of the unfragmented zone;

thereafter placing explosive in the remaining portion of the unfragmented zone;

thereafter detonating the explosive in the remaining portion to explosively expand the remaining portion of the unfragmented zone into the upper void and the space free of fragmented particles below the remaining portion of the unfragmented zone to thereby produce a fragmented, permeable mass of particles within the boundaries of an in situ oil shale retort being formed and having a void volume substantially equal to the total initial volume of the upper and lower voids;

heating the expanded portion of the oil shale deposit to liquefy carbonaceous values therein by maintaining a downward pressure differential of gas through the fragmented permeable mass; and recovering shale oil from the base of in situ retort.

9. The method according to claim 8 comprising forming a sufficient number of vertically spaced apart voids to form an in situ retort having a greater height than width after explosive expansion of the unfragmented zones.

10. The method according to claim 8 wherein each void is excavated to a generally rectangular horizontal cross section with the corresponding edges of the rectangles generally coplanar with one another so that the in situ retort produced after expansion of intervening unfragmented zones is of generally rectangular horizontal cross section from top to bottom.

11. The method according to claim 8 wherein the combined volume of the voids equals about 10% to 20% of the total volume of the in situ retort after expansion.

12. The method according to claim 8 wherein the step of placing explosive after the first detonation step comprises loading explosive into the remaining unfragmented zone from the work space provided by the upper void.

13. The method according to claim 8 wherein the excavating step comprises forming a plurality of said vertically spaced apart voids which are separated by a plurality of said unfragmented zones spaced vertically apart above one another within the deposit; and wherein said alternating steps of placing explosive and detonating the explosive are carried out for completely fragmenting the ore in the unfragmented zones, by following said alternating steps, one zone at a time, from the bottom up, until all unfragmented zones are explosively expanded.

14. A method for forming an in situ oil shale retort containing a fragmented permeable mass of particles in a subterranean deposit containing oil shale comprising the steps of excavating a plurality of vertically spaced apart voids, wherein the horizontal cross section of each void is substantially similar to the horizontal cross section of the in situ oil shale retort being formed and including a lower void and at least one void is located substantially directly above said lower void, and leaving an intervening unfragmented zone of deposit between adjacent voids; and explosively expanding each unfragmented zone downwardly toward a lower void in a plurality of sequential portions from the bottom up, the final portion also expanding upwardly toward the void above the zone to produce a fragmented, permeable mass of particles within the boundaries of the in situ oil shale retort having a void volume substantially equal to the total volume of the voids within the boundaries of the in situ oil shale retort being formed.

15. The method according to claim 14 wherein the excavating step comprises forming a sufficient number of vertically spaced apart voids to produce a subterranean in situ oil shale retort having a greater height than width after explosive expansion of intervening unfragmented zones.

16. The method according to claim 15 wherein each void is excavated to a generally rectangular horizontal cross section with the corresponding edges of the rectangles generally coplanar with one another so that the in situ oil shale retort produced after expansion of intervening unfragmented zones is of generally rectangular horizontal cross section from in situ oil shale to bottom.

17. The method according to claim 14 wherein adjacent voids are spaced apart so that the vertical dimension of the intervening unfragmented zone is greater than the smallest lateral dimension of either the upper or lower void.

18. The method according to claim 14 wherein the combined volume of the voids equals about 10% to 20% of the total volume of the desired subterranean in situ oil shale retort after expansion.

19. A method of forming an in situ oil shale retort containing a fragmented permeable mass of oil shale particles in a subterranean deposit, which comprises the steps of:

excavating a plurality of vertically spaced apart voids with a zone of unfragmented deposit between adjacent voids and within the boundaries of the in situ oil shale retort being formed;

explosively expanding at least one lower portion of such an unfragmented zone downwardly toward a lower void; and thereafter explosively expanding an upper remaining portion of such an unfragmented zone at least partly toward an upper void to form a fragmented permeable mass of particles within the boundaries of the in situ oil shale retort being formed, wherein the void volume of the fragmented permeable mass of particles in the in situ oil shale retort is substantially equal to the total volume of the voids within the boundaries of the in situ oil shale retort being formed.

20. A method as recited in claim 19 wherein the volume of the voids is in the range of from about 10 to 20% of the volume of the in situ retort to be formed.

21. A method as recited in claim 19 wherein the unfragmented zone has a thickness of greater than about the smallest lateral dimension of the voids toward which it is to be expanded.

22. A method as recited in claim 19 wherein unfragmented oil shale is prepared for explosive expansion by forming vertical blasting holes in such an unfragmented zone between the voids.

23. The method according to claim 19 comprising forming a sufficient number of vertically spaced apart voids to form an in situ retort having a greater height than width after explosive expansion of the unfragmented zones.

24. The method according to claim 23 wherein each void is excavated to a generally rectangular horizontal cross section with the corresponding edges of the rectangles generally coplanar with one another so that the in situ retort produced after expansion of intervening unfragmented zones is of generally rectangular horizontal cross section from top to bottom.

25. The method according to claim 19 wherein the horizontal cross section of each void is substantially similar to the horizontal cross section of the in situ oil shale retort being formed.

26. A method for forming an in situ oil shale retort in a subterranean oil shale deposit comprising the steps of:

excavating a lower void having a horizontal cross section corresponding to a desired horizontal cross section of an in situ oil shale retort;

excavating an upper void having a horizontal cross section corresponding to the horizontal cross section of the lower void and spaced substantially directly above the lower void a distance greater than about the minimum lateral dimension of either void, thereby leaving a zone of unfragmented oil shale deposit between the lower void and the upper void;

excavating an intermediate void having a horizontal cross section corresponding to the horizontal cross section of the lower void and spaced directly above the lower void and directly below the upper void and spaced from each void a distance greater than about the minimum lateral dimension of either void, thereby subdividing the oil shale deposit into two zones of unfragmented oil shale deposit each having a thickness not appreciably less than the smallest lateral dimension of the void into which the oil shale is to be expanded;

explosively expanding a lower portion of the lower unfragmented zone toward the lower void to produce a permeable mass of fragmented particles and a space free of fragmented particles below the remaining portion of the lower unfragmented zone;

explosively expanding the remaining portion of the lower unfragmented zone toward the intermediate void and the space free of fragmented particles below the remaining portion of the lower unfragmented zone;

explosively expanding a lower portion of the upper unfragmented zone toward the intermediate void to produce a permeable mass of fragmented particles and a space free of fragmented particles below the remaining portion of the upper unfragmented zone; and explosively expanding the remaining portion of the upper unfragmented zone toward the upper void and the space free of fragmented particles below the remaining portion of the upper unfragmented zone.

27. A method as recited in claim 26 wherein each unfragmented zone has a thickness between the voids of less than about 190 percent of the smallest lateral dimension of either void.

28. A method of forming an in situ oil shale retort containing a fragmented permeable mass of oil shale particles in a subterranean deposit, which comprises the steps of:

excavating a plurality of vertically spaced apart voids with a zone of unfragmented deposit between vertically adjacent voids, wherein the horizontal cross section of each void is substantially similar to the horizontal cross section of the in situ oil shale retort being formed; and explosively expanding at least one lower portion of such an unfragmented zone downwardly toward a lower void;

thereafter explosively expanding an upper remaining portion of such an unfragmented zone at least partly toward an upper void to form a fragmented permeable mass of particles in an in situ oil shale retort being formed.

29. A method of forming an in situ oil shale retort containing a fragmented permeable mass of oil shale particles in a subterranean deposit which comprises the steps of:

excavating a plurality of vertically spaced apart voids with a zone of unfragmented deposit between adjacent vertically spaced apart voids, said unfragmented zone having a free face of deposit adjoining each of the adjacent vertically spaced apart voids;

forming a plurality of vertically extending blasting holes in such an unfragmented zone;

detonating explosive in at least a portion of said blasting holes for explosively expanding at least one lower portion of such an unfragmented zone downwardly toward such a free face of deposit adjacent a lower void; and thereafter detonating explosive in at least a portion of said blasting holes for explosively expanding an upper remaining portion of such an unfragmented zone at least partly toward such a free face of deposit adjacent an upper void to form a fragmented permeable mass of particles within the boundaries of the in situ oil shale retort being formed.

30. The method according to claim 29 wherein the horizontal cross section of each void is substantially similar to the horizontal cross section of the in situ oil shale retort being formed.

31. The method according to claim 30 wherein the void volume of the fragmented permeable mass of particles in the in situ oil shale retort is substantially equal to the total volume of the voids within the boundaries of the in situ oil shale retort being formed.

* * * * *

UNITED STATES PATENT AND TRADEMARK OFFICE

CERTIFICATE OF CORRECTION

PATENT NO. : 4,043,597
DATED : August 23, 1977
INVENTOR(S) : Gordon B. French

It is certified that error appears in the above-identified patent and that said Letters Patent are hereby corrected as shown below:

Column 3, line 52, -- mining -- should be inserted after "bulky" and before "machinery".

Column 5, line 8, "oi" should be -- oil --.

Column 6, lines 57, 58, -- free -- should be inserted after "the" and before "face".

Column 13, line 17, "in situ oil shale" should be -- top --.

Column 13, line 51, "the" should be -- such an --.

Signed and Sealed this

*Twenty-second* Day of *November 1977*

[SEAL]

*Attest:*

RUTH C. MASON
*Attesting Officer*

LUTRELLE F. PARKER
*Acting Commissioner of Patents and Trademarks*